US009545731B2

(12) United States Patent
Reid et al.

(10) Patent No.: US 9,545,731 B2
(45) Date of Patent: Jan. 17, 2017

(54) PERSONAL GROOMING DEVICE

(71) Applicants: Sheldon Reid, North Canton, OH (US); Francis Factora, North Canton, OH (US)

(72) Inventors: Sheldon Reid, North Canton, OH (US); Francis Factora, North Canton, OH (US)

( * ) Notice: Subject to any disclaimer, the term of this patent is extended or adjusted under 35 U.S.C. 154(b) by 7 days.

(21) Appl. No.: 13/848,147

(22) Filed: Mar. 21, 2013

(65) Prior Publication Data

US 2013/0247394 A1 Sep. 26, 2013

Related U.S. Application Data

(60) Provisional application No. 61/614,023, filed on Mar. 22, 2012.

(51) Int. Cl.

| | |
|---|---|
| ***B26B 21/40*** | (2006.01) |
| ***B26B 21/52*** | (2006.01) |
| ***B26B 21/08*** | (2006.01) |

(52) U.S. Cl.

CPC ..... *B26B 21/4062* (2013.01); *B26B 21/08* (2013.01); *B26B 21/522* (2013.01); *B26B 21/526* (2013.01)

(58) Field of Classification Search

CPC .. B26B 21/08; B26B 21/4012; B26B 21/4062; B26B 21/4075; B26B 21/52; B26B 21/521; B26B 21/523

USPC ..... 30/526–533

See application file for complete search history.

(56) References Cited

U.S. PATENT DOCUMENTS

| | | | | | |
|---|---|---|---|---|---|
| 831,259 | A | * | 9/1906 | Bingler | 30/531 |
| 1,247,581 | A | * | 11/1917 | Seitz | 30/531 |
| 1,976,290 | A | | 10/1934 | Motley | |
| 2,034,262 | A | | 3/1936 | Marrazzo | |
| 2,113,772 | A | * | 4/1938 | Rothschild et al. | 30/40 |
| D159,994 | S | | 9/1950 | Lee | |
| 2,530,917 | A | | 11/1950 | Taylor | |
| 2,565,062 | A | * | 8/1951 | Blanchard | 30/40 |
| 2,748,470 | A | * | 6/1956 | Borden | 30/531 |
| 2,780,866 | A | * | 2/1957 | Borden | 30/531 |
| 3,430,341 | A | * | 3/1969 | Choate | 30/40 |
| 3,619,900 | A | * | 11/1971 | Matsuura | 30/40 |
| 3,797,109 | A | * | 3/1974 | Yamada et al. | 30/531 |
| 3,964,160 | A | * | 6/1976 | Gordon | 30/531 |
| 4,083,103 | A | * | 4/1978 | Estandian | 30/531 |
| 4,617,736 | A | * | 10/1986 | McCrary | 30/527 |
| 5,070,614 | A | * | 12/1991 | Hardin et al. | 30/527 |
| 5,093,991 | A | * | 3/1992 | Hendrickson | 30/531 |
| 5,199,173 | A | * | 4/1993 | Hegemann et al. | 30/531 |
| 5,526,568 | A | * | 6/1996 | Copelan | 30/531 |
| 5,787,594 | A | * | 8/1998 | Estrada | 30/531 |
| 5,979,056 | A | | 11/1999 | Andrews | |

(Continued)

FOREIGN PATENT DOCUMENTS

| | | |
|---|---|---|
| EP | 0707926 A1 | 4/1996 |
| GB | 2383970 A | 7/2003 |

(Continued)

*Primary Examiner* — Jason Daniel Prone

(57) ABSTRACT

Some embodiments may include a personal grooming device. Such a device may include a head portion. The head portion may include a means for mounting at least one razor. An embodiment may also include a means for rotating the razor clockwise and/or counterclockwise by a predefined number of degrees less than one full turn.

1 Claim, 4 Drawing Sheets

(56) References Cited

U.S. PATENT DOCUMENTS

| | | | | |
|---|---|---|---|---|
| 6,018,877 | A | 2/2000 | Greene | |
| 6,115,924 | A * | 9/2000 | Oldroyd | 30/527 |
| 6,223,442 | B1 * | 5/2001 | Pina | 30/527 |
| 6,267,117 | B1 | 7/2001 | Bisson | |
| 6,581,290 | B1 * | 6/2003 | Fishel | 30/526 |
| 7,140,116 | B2 * | 11/2006 | Coffin | 30/531 |
| 7,243,428 | B2 | 7/2007 | Okaniwa | |
| 7,721,451 | B2 * | 5/2010 | Psimadas et al. | 30/527 |
| 8,127,453 | B2 * | 3/2012 | Haczek et al. | 30/527 |
| 8,595,938 | B2 * | 12/2013 | Bodet | 30/527 |
| 8,671,576 | B1 * | 3/2014 | Hotella | 30/526 |
| 8,720,072 | B2 * | 5/2014 | Bucco | 30/527 |
| 2008/0216329 | A1 * | 9/2008 | Leventhal | 30/527 |
| 2012/0210586 | A1 * | 8/2012 | Lelieveld et al. | 30/527 |
| 2012/0246947 | A1 * | 10/2012 | Fang et al. | 30/526 |
| 2012/0291295 | A1 * | 11/2012 | Braun | 30/531 |
| 2013/0111759 | A1 * | 5/2013 | Pohl et al. | 30/531 |
| 2014/0237829 | A1 * | 8/2014 | Roden | 30/531 |
| 2015/0089822 | A1 * | 4/2015 | Reid | B26B 21/4062 30/532 |

FOREIGN PATENT DOCUMENTS

| | | | |
|---|---|---|---|
| WO | 2007/060590 | A2 | 5/2007 |
| WO | 2011/073857 | A1 | 6/2011 |

* cited by examiner

PERSONAL GROOMING DEVICE

I. REFERENCE TO RELATED APPLICATIONS

This application claims priority to U.S. Provisional Patent Application No. 61/614,023 filed on Mar. 22, 2012 and now pending, which is incorporated herein by reference in its entirety.

II. BACKGROUND OF THE INVENTION

A. Field of Invention

One or more embodiments of the invention may generally relate to devices for grooming.

B. Description of the Related Art

It is known to use razor blades to trim body hair on, for instance, the face, legs, or head. Various devices are presently available for this purpose but all have certain shortcomings. For instance, a typical hand held non-electric razor is suitable for shaving the face, but is awkward to use for shaving the head. In part this is due to the need for holding the razor in un-natural positions in order to achieve an appropriate contact angle between the razor and the skin for an effective cut. Furthermore, one must not only hold known devices in awkward positions, but must also reposition the device, often blindly, so that all parts of the head can be accessed for shaving.

What is needed is a device which is more conveniently held and repositioned. One or more embodiments of the invention may overcome a shortcoming of the prior art.

III. SUMMARY OF THE INVENTION

Some embodiments of the present invention relate to a personal grooming device, comprising: a head portion including a face having a means for mounting at least one razor to the head portion; and a means for rotating the at least one razor head clockwise and/or counterclockwise by a predefined number of degrees less than one full turn.

Some embodiments may further comprise a handle portion defining a generally elongate structure having a first end and second end, wherein the first end supports the head portion.

According to some embodiments the means for mounting the at least one razor to the head portion includes a release mechanism for dismounting the razor from the device.

According to some embodiments the means for rotating is adapted to rotate a disposable razor in steps from about 1 to 10 degrees, 10 to 20 degrees, 20 to 30 degrees, 30 to 40 degrees, 40 to 50 degrees, 50 to 60 degrees, 60 to 70 degrees, 70 to 80 degrees, 80 to 90 degrees, 90 to 100 degrees, 100 to 110 degrees, 110 to 120 degrees, 120 to 130 degrees, 130 to 140 degrees, 140 to 150 degrees, 150 to 160 degrees, 160 to 170 degrees, 170 to 180 degrees, 180 to 190 degrees, 190 to 200 degrees, 200 to 210 degrees, 210 to 220 degrees, 220 to 230 degrees, 230 to 240 degrees, 240 to 250 degrees, 250 to 260 degrees, 260 to 270 degrees, 270 to 280 degrees, 280 to 290 degrees, 290 to 300 degrees, 300 to 310 degrees, 310 to 320 degrees, 320 to 330 degrees, 330 to 340 degrees, 340 to 350 degrees, and/or about 350 to 359 degrees or any combination thereof.

According to some embodiments the means for rotating is adapted to rotate a disposable razor in step of about 1, 2, 3, 4, 5, 6, 7, 8, 9 and/or about 10 degrees or any combination thereof.

According to some embodiments the means for rotating includes: a lever having a first end an second end and a pivot point between the first and second ends, the pivot point cooperating in a pivotable relation with an annulus on an internal surface of the head portion; a manual switching means engaging the first end of the lever and adapted to rotate the lever about the pivot point; and a first gear rotatably mounted to an interior surface of the head portion and adapted to engage and cooperate with the second end of the lever so that movement of the second end of the lever causes rotation of the first gear, and wherein the first gear mechanically cooperates with the means for mounting at least one razor to the head portion such that rotation of the first gear causes rotation of the means for mounting.

Some embodiments may further comprise a planetary gear rotatably engaging the first gear, wherein the planetary gear shares a central rotational axis with the means for mounting the at least one razor to the head portion.

According to some embodiments the means for rotating includes: an electrical power supply disposed on-board the device; a solenoid mounted to an interior surface of the device and having a movable armature, the solenoid being in electrical communication with the power supply; a manually actuated electrical switching means in electrical communication between the power supply and the solenoid, wherein the switching means is adapted to energize and de-energize the solenoid; a first gear rotatably mounted to an interior surface of the head portion, wherein the first gear mechanically cooperates with the means for mounting at least one razor to the head portion such that rotation of the first gear causes rotation of the means for mounting; and a linkage adapted to transmit movements of the armature to the first gear resulting in rotation of the first gear.

Some embodiments may further comprise a planetary gear rotatably engaging the first gear, wherein the planetary gear shares a central rotational axis with the means for mounting the at least one razor to the head portion.

Some embodiment may relate to a personal grooming device, comprising: a head portion including a face having a means for mounting at least one razor to the head portion, wherein the means for mounting the at least one razor to the head portion includes a release mechanism for dismounting the razor from the device; a handle portion defining a generally elongate structure having a first end and second end, wherein the first end supports the head portion; and a means for rotating the at least one razor head clockwise and/or counterclockwise by a predefined number of degrees less than one full turn.

Some embodiments may relate to a personal grooming device, comprising: a head portion including a face having a means for mounting at least one razor to the head portion, wherein the means for mounting the at least one razor to the head portion includes a release mechanism for dismounting the razor from the device; a handle portion defining a generally elongate structure having a first end and second end, wherein the first end supports the head portion; and a means for rotating the at least one razor head clockwise and/or counterclockwise by a predefined number of degrees less than one full turn, wherein the means for rotating includes a first gear rotatably mounted to an interior surface of the head portion and adapted to cooperate with a manually actuated means for rotating the first gear, and wherein the first gear mechanically cooperates with the means for mounting at least one razor to the head portion such that rotation of the first gear causes rotation of the means for mounting.

Other benefits and advantages will become apparent to those skilled in the art to which it pertains upon reading and understanding of the following detailed specification.

VI. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

V. DETAILED DESCRIPTION OF THE INVENTION

Embodiments of the invention generally relate to a personal grooming device for shaving parts of the body such as, for instance, the head. In general, embodiments include a handle portion terminating at one end in a head portion. A head portion typically includes at least one generally flat area adapted to support at least one mount for fixedly holding a disposable razor blade. Furthermore, embodiments can include a means for rotating a razor head through a predetermined number of degrees, and may allow for quickly reversing the cutting direction of the razor blade.

A suitable handle portion can include a generally elongate structure having a first end and a second end, where one end terminates in a head portion. Some embodiments may include a contoured handle portion. For example, a contoured handle portion may be adapted to ergonomically fit the grip of an average user or of a specific user, and accordingly, may include one or more indentations for accommodating the digits of a user's hand. However, other embodiments may include a handle portion having any convenient shape such as a simple rectangular or circular cylindrical shape. Furthermore, embodiments may lack a handle entirely, and instead include a means for holding the head portion on a finger. For instance, a ring structure suitable for receiving a human finger may be used for holding and/or operating the device.

A suitable head portion can include a wide variety of shapes and contours provided they are suitable for cooperating with a mounting mechanism for fixedly attaching a disposable razor head to the device. Non-limiting examples of suitable shapes for head portions include those having at least one generally flat surface suitable for cooperating with a mounting mechanism for presenting a mounted razor head to a body surface in a cutting relation. In some embodiments a generally flat surface can include a contoured surface which is specially shaped to align a razor head with a body surface. Furthermore, some embodiments can include a recessed mount for receiving a razor head in a fixed relation recessed into the head portion.

Mechanisms for rotating disposable razor heads according to embodiments of the invention can include a wide variety of suitable means. For instance, embodiments may include purely mechanical means for rotating a razor head which may be manually actuated and may or may not include a spring-loaded means. Alternatively, embodiments may include electrically powered means for rotating a razor head such as a battery powered motor, solenoid, or other electromechanical means.

Figure 1:
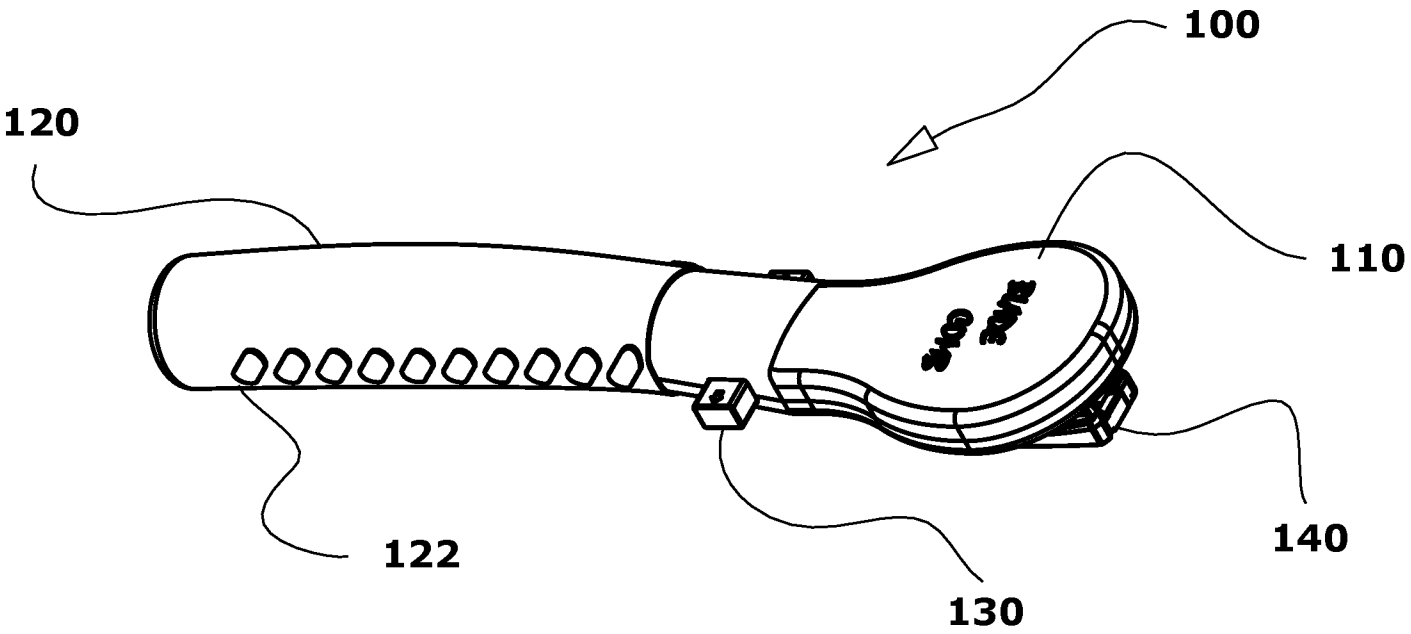
FIG. 1 is a perspective view drawing of an embodiment.
Figure 2:
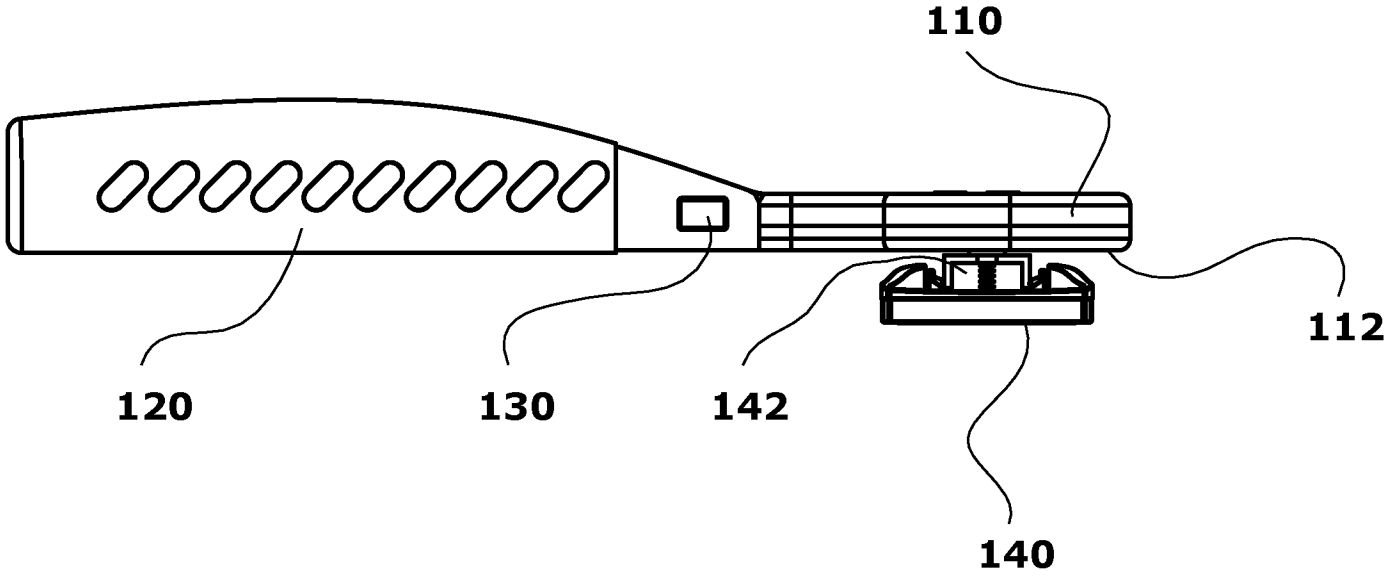
FIG. 2 is a side-view of an embodiment.

Furthermore, suitable handle portions and/or head portions are made from generally water-resistant materials such as organic polymer materials known in the art. For instance, polyolefins, polyesters, phenolic polymers, acrylonitrile butadiene styrene (ABS) polymers, polystyrenes, polycarbonates, polyvinyl chlorides (PVC), polyamides, polyimides, polymelamines, polyurethanes, polyacetals, polyetheretherketones (PEEK), polyionomers, polybutylenes, polyphenylene oxides, or polyphenylene sulfides, or any combination thereof Referring now to the drawings wherein the showings are for purposes of illustrating embodiments of the invention only and not for purposes of limiting the same, FIG. 1 is a drawing of an embodiment 100 having a head portion 110 and a handle portion 120. The handle portion 120 includes a grip 122 adapted to promote non-slip handling of the embodiment 100. The embodiment also includes a razor blade 140 attached to a face of the embodiment 100. The razor 140 is adapted to rotate 180° in response to movement of a manually actuated lever 130. FIG. 2 shows the same embodiment from a side. The face 112 of the head portion 110 is visible in this view, along with a means for mounting 142 the razor 140 to the head portion 110. One skilled in the art will appreciate that the particular means for mounting can be selected from any of a wide variety of means known in the art. For example, and without limitation, appropriate means for mounting a razor 140 can include a releasable mechanism such as a spring-load releasable mechanism adapted to hold a razor 140 until/unless the spring force is overcome thereby releasing the razor 140. Other means may comprise a permanent mount, wherein the overall device 100 comprises a disposable device.

Figure 3:
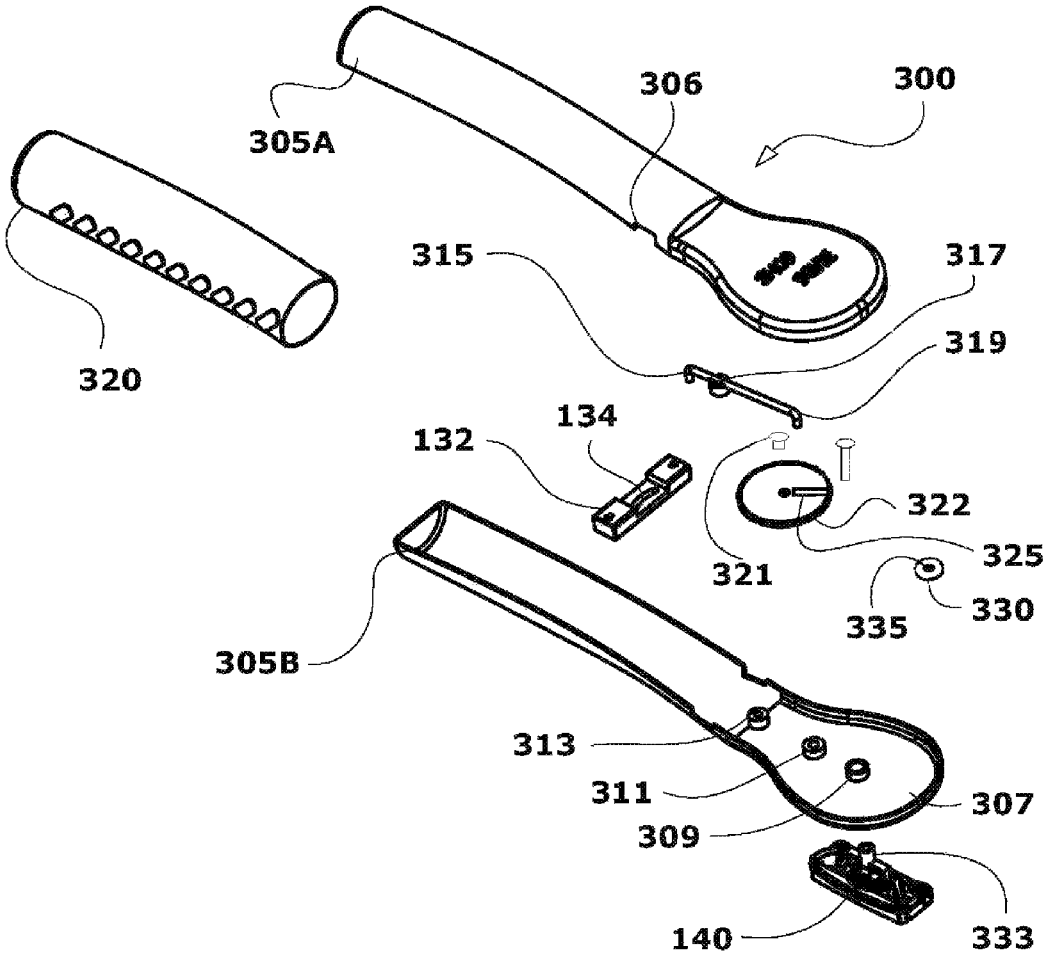
FIG. 3 is an exploded view of a manual embodiment.

FIG. 3 is an exploded view of one particular embodiment 300. The embodiment 300 includes an upper enclosure 305A and a lower enclosure 305B. The grip 320 fits over the handle portion of the assembled enclosure. The manually actuated lever 130 of FIG. 1 is shown to have a pair of tabs 132 which protrude from an aperture 306 on either side of the enclosure. The lever 130 also includes a recess 134 which is adapted to engage a first end 315 of a linkage. The linkage also has an off-center pivot point 317 which pivotally engages an annulus 313 formed upon an interior surface 307 of the lower enclosure 305B. The second end 319 of the linkage engages a slot 325 of a gear 322. The gear 322 is rotatably mounted by a pin 321 to an annulus 311 formed upon the interior surface 307 of the lower enclosure 305B.

Accordingly, depressing the tabs 132 causes the linkage to pivot about its pivot point 317, which results in the second end of the linkage 319 moving from side to side. This in turn causes the gear 322 to rotate. The particular embodiment illustrated in FIG. 3 also includes a planetary gear 330 having a central aperture 335. The mounting post 333 of the razor 140 is inserted into aperture 309 and protrudes into the interior of the enclosure. The portion of the mounting post 333 which clears the top edge of the aperture 309 engages the planetary gear 330 through its central aperture 335 in a press fit. The planetary gear 330 rotatably engages the gear 322, which thus functions as a sun gear. Accordingly, rotation of the sun gear 322 causes rotation of the planetary gear 330 which in in turn rotates the razor 140.

Figure 4:
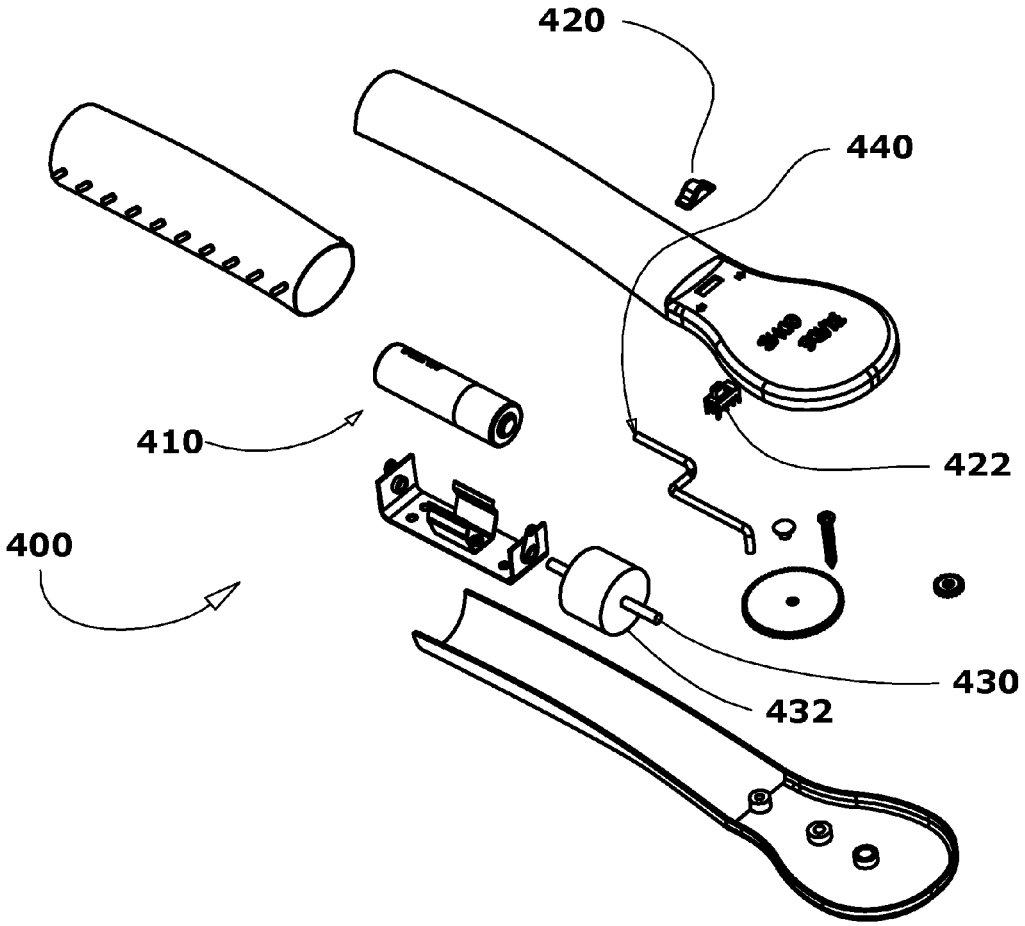
FIG. 4 is an exploded view of an electrical embodiment.

FIG. 4 illustrates an electrically powered embodiment 400. The embodiment of FIG. 4 is similar to that of FIG. 3 except for the replacement of certain manual components with electrical alternatives. For example, the manually actuated lever 130 is replaced with a solenoid 430 which electrically communicates with a power supply 410 through a switch 422. The switch is conveniently fitted with a cap 420 to permit a user to easily operate the switch 422. Actuating the switch 422 either energizes or de-energizes the solenoid 430 depending on the position of the switch 422. For instance, depending on the state of the solenoid 430 the armature 432 may be extended or retracted. Furthermore, the armature 432 engages and mechanically cooperates with an end of a linkage 440. The linkage 440 of this embodiment behaves similarly to the linkage of FIG. 3 in its engagement of a planetary gear system to rotate a razor 140. Of course, it differs in that the linkage 440 of this embodiment 400 moves fore and aft rather than in a pivoting motion.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

We claim:

1. A personal grooming device, comprising:

a handle portion (120) having a generally elongate shape;

a head portion (110) disposed at an end of the handle portion (120);

a razor blade (140) rotatably attached to a face (112) of the head portion (110), and being adapted to reversibly rotate through a one hundred eighty degree range of motion, wherein the razor blade (140) is in an operable orientation at either end of the one hundred eighty degree range of motion;

a manually actuatable lever (130) in mechanical communication with the razor blade (140) and adapted to cause the razor blade (140) to reversibly rotate through the one hundred eighty degree range of motion;

an enclosure (305A, 305B) defining a hollow space within the head portion (110), wherein the face (112) area of the head portion (110) includes an aperture (309) extending into the hollow space of the head portion (110), the aperture (309) of the face (112) area being adapted to receive a mounting post (333) of the razor blade (140);

a planetary gear (330) having a central aperture (335) sharing a common axis with the aperture (309) extending into the hollow space of the head portion (110), the planetary gear (330) being adapted to press fit to the mounting post (333), wherein the planetary gear (330), aperture (309) and mounting post (333) cooperate to define the rotatable attachment between the razor blade (140) and the head portion (110);

a sun gear (322) mounted by a pin (321) to an annulus (311) formed upon an interior surface (307) of the enclosure (305B), the sun gear (322) rotatably engaging the planetary gear (330);

a linkage having a first end (315), a second end (319), and an off-center pivot point (317) between the first end (315) and the second end (319), wherein the second end (319) of the linkage slidably engages a radial slot (325) in the sun gear (322), and wherein the off-center pivot point (317) engages an annulus (313) formed upon the interior surface (307) of the enclosure (305B); and the lever (130) having tabs (132) at either end, and a recess (134) between the tabs (132), the recess (134) being adapted to engage the first end (315) of the linkage, wherein the tabs (132) of the lever protrude from opposing lever apertures (306) of the enclosure (305A, 305B), wherein the linkage, the sun gear (322) and the planetary gear (330) cooperate to define the mechanical communication between the razor blade (140) and the lever (130).

* * * * *